US005713676A

United States Patent [19]

Seybold

[11] Patent Number: 5,713,676

[45] Date of Patent: Feb. 3, 1998

[54] INK RIBBON CASSETTE HAVING FLEXIBLE SPACERS

[75] Inventor: James M. Seybold, Centerville, Ohio

[73] Assignee: NCR Corporation, Dayton, Ohio

[21] Appl. No.: 807,799

[22] Filed: Feb. 28, 1997

[51] Int. Cl.[6] ..... B41J 27/12; B41J 33/10

[52] U.S. Cl. ..... 400/196.1; 400/208; 400/236.1; 400/247

[58] Field of Search ..... 400/196.1, 207, 400/208, 247, 248, 194, 196, 236.1

[56] References Cited

U.S. PATENT DOCUMENTS

| | | | |
|---|---|---|---|
| 5,007,750 | 4/1991 | Goubeaux | 400/196.1 |
| 5,018,885 | 5/1991 | Uggetti | 400/196 |
| 5,186,554 | 2/1993 | Mizutani et al. | 400/247 |
| 5,248,207 | 9/1993 | Yamamoto et al. | 400/208 |
| 5,399,033 | 3/1995 | Putman | 400/196.1 |
| 5,413,424 | 5/1995 | Silverstein | 400/196.1 |
| 5,472,286 | 12/1995 | Uemura et al. | 400/196.1 |

*Primary Examiner*—Eugene H. Eickholt
*Attorney, Agent, or Firm*—Charlene Stukenborg

[57] ABSTRACT

Ink ribbon cassette having flexible spacers for insuring that the ratchet of the cassette is engaged by the teeth of the ratchet and pawl of the printer are provided. In particular, the present invention provides flexible spacers for the ink ribbon cassettes used in the new style 2170 printer, a Showa-Seiki HS-45.

5 Claims, 1 Drawing Sheet

INK RIBBON CASSETTE HAVING FLEXIBLE SPACERS

The present invention relates to ink ribbon cassettes having flexible spacers to insure engagement with a printer's cassette drive mechanism.

BACKGROUND OF THE INVENTION

Ink ribbon printers have various cassette drive mechanisms which advance the ink ribbon as the printer operates. One such cassette drive mechanism includes a ratchet pawl in the printer which engages a ratchet of the cassette. The ratchet of the cassette causes gears to advance the ink ribbon as the printer operates. The printer generally provides a definite positional relationship between the printer's ratchet pawl and the cassette's ratchet, so the printer operator can latch the cassette in place and the necessary engagement occurs.

The printer for the new style 2170, a Showa-Seiki HS-45, uses a ratchet pawl cassette drive mechanism. As is typical, the ink ribbon cassette is latched onto the printer in a fixed position. However, in this printer, the printer's ratchet pawl has an adjustable range of positions. This adjustable range of positions can result in the ratchet pawl not engaging the ratchet of a properly latched ink ribbon cassette. If the ratchet of the properly latched ink ribbon cassette is not engaged, the ink ribbon will not advance. The ink ribbon cassette is usually considered defective and thus discarded.

Currently, it is not known if the printer adjustable range of positions will be modified to prevent this non-engagement problem. Even if the printer is modified, there are many existing printers with the adjustable range of ratchet pawl positions. Therefore, there is a need for ink ribbon cassettes having flexible spacers for insuring the ratchet of the cassette is engaged by the ratchet pawl of the printer.

SUMMARY OF THE INVENTION

In accordance with the teachings of the present invention, ink ribbon cassettes having flexible spacers for insuring that the ratchet of the cassette is engaged by the ratchet pawl of the printer are provided. In particular, the present invention provides flexible spacers for the ink ribbon cassettes used in the new style 2170 printer.

It is an object of the present invention to provide ink ribbon cassettes having flexible spacers to insure the ink ribbon will advance when mounted in a new style 2170 printer.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION

Figure 1A:
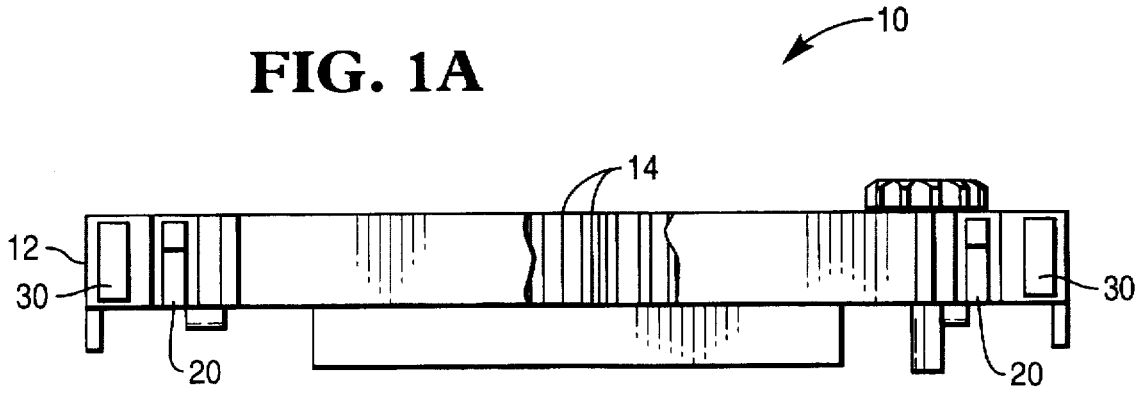
FIG. 1A shows a side view of an ink ribbon cassette having flexible spacers in accordance with the present invention.
Figure 1B:
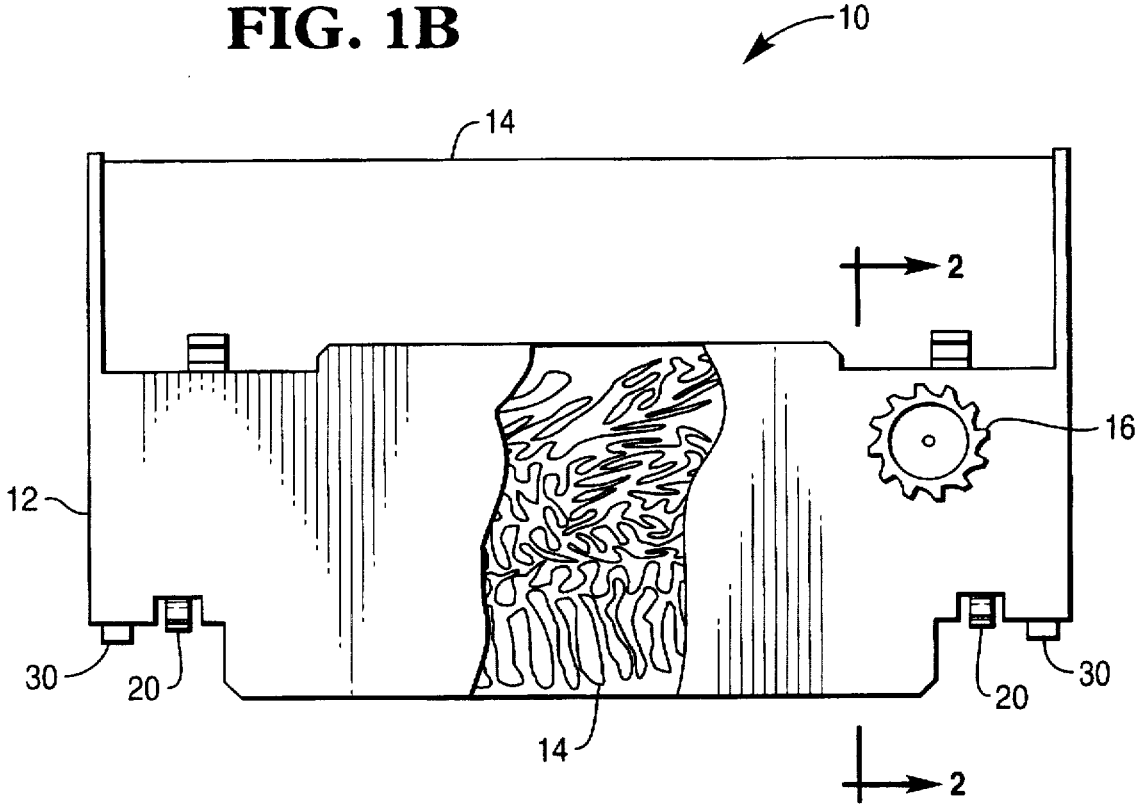
FIG. 1B shows a bottom view of the ink ribbon cassette having flexible spacers in accordance with the present invention.
Figure 2:
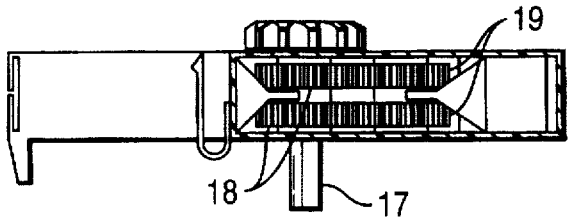
FIG. 2 shows a cross-sectional view taken along reference line 2—2 in FIG. 1B.

Referring now to the drawings, in which like-referenced characters indicate corresponding elements throughout the several views, attention is drawn to FIGS. 1A 1B, and 2 which show a side view, a bottom view, and a cross-section of the bottom view of an ink ribbon cassette 10 having flexible spacers 30 in accordance with the present invention. The ink ribbon cassette 10 is used in the new style 2170 printer (HS-45) which is available from Showa-Seiki. The ink ribbon printer cassette 10 includes a housing 12, formed of ABS plastic, a synthetic resin plastic, or like material commonly used to mold housings for ribbon cassettes. Ink ribbon printer cassette 10 also includes a ribbon 14, preferably a nylon ribbon. The ink ribbon 14 is stored in the housing 12 of ink ribbon cassette 10 until just before it is guided in front of a print head for printing. The housing 12 includes latches 20 and additional latches to positively position the ink ribbon cassette onto the printer.

The housing 12 also includes a ratchet 16 which is intended to be engaged by the ratchet pawl of the printer. Ratchet 16 connects to a first gear 18 (shown in FIG. 2) located inside housing 12 and a knob extension 17. Housing 12 also includes a second gear 19 (shown in FIG. 2) which engages with the first gear 18 to advance the ink ribbon 14. As discussed above, if the ratchet 16 is not engaged by the ratchet pawl of the printer, then ink ribbon 14 is not advanced, and the ink ribbon is generally considered defective.

To eliminate the potential for the ratchet pawl of the printer from not engaging the ratchet 16 of the ink ribbon cassette 10, flexible spacers 30 are provided according to the present invention. Flexible spacers 30 are preferably mounted on the outside of housing 12 adjacent to latches 20 as shown in FIGS. 1A and 1B. This placement of the flexible spacers 30 enables the cassette 10 to be latched in place using latches 20 but also provides a slight force on the cassette pushing the cassette into alignment with the printer's ratchet pawl. The design of the ratchet pawl prevents the cassette 10 from being pushed too far towards the ratchet pawl. Therefore, the flexible spacers are compressed by any additional force insuring that the cassette's ratchet 16 aligns with the printer's ratchet pawl.

Flexible spacers are preferably formed of a compressible foam but may be formed of other types of compressible material such as rubber, fabric, etc. The dimensions of the flexible spacers may vary depending on the application, however, a thickness of about 1/16 inch is preferred with the 2170 printer. Flexible spacers 30 may be attached to the cassette by any known means such as by applying pressure sensitive adhesive to the side of the spacer adjacent the cassette housing. Flexible spacers 30 may alternatively be formed of a slightly tacky material which readily attaches to the cassette housing. Also with cassettes for use in the 2170 printer, it is preferred that each flexible spacer 30 is mounted within about 1/32 inch of each latch 20. Additionally, the flexible spacers 30 preferably should not extend below the bottom of the cassette but should attach to within 1/32 inch of the bottom. Preferably, each flexible spacer 30 should be substantially perpendicular to the cassette bottom as possible.

Although the above description provides for two flexible spacers located on the outside of positioning latches, it is contemplated that the present invention includes any placement of flexible spacers which allow the cassette to be latched into place but still provides slight pressure on the cassette to insure the cassette's ratchet aligns with the printer's ratchet pawl.

Advantageously, the apparatus of the present invention provides an ink ribbon cassette which will be engaged by the ratchet pawl drive of the printer despite variations in the printer's ratchet pawl dimensions.

Yet another advantage of the present invention is that the flexible spacers can be relatively easily incorporated into the current cassette design.

Although the invention has been described with particular reference to certain preferred embodiments thereof, variations and modifications of the present invention can be effected within the spirit and scope of the following claims.

What is claimed is:

1. An ink ribbon cassette having a ratchet for engagement with a ratchet pawl mechanism of a printer to advance an ink ribbon, comprising:

a housing for positioning the ink ribbon; and at least one flexible spacer attached to the outside of the housing for insuring the position of the ink ribbon cassette ratchet is such that the ratchet pawl mechanism of the printer engages the ink ribbon cassette ratchet.

2. The ink ribbon cassette of claim 1 wherein the ink ribbon cassette is used in a 2170 printer.

3. The ink ribbon cassette of claim 2 wherein the at least one flexible spacer is compressible, allowing the ink ribbon cassette to latch to the printer.

4. The ink ribbon cassette of claim 3 wherein the at least one flexible spacer is foam.

5. In an ink ribbon cassette for use in a 2170 printer, the improvement comprising:

at least two flexible spacers attached to a housing of the ink ribbon cassette for positioning the ink ribbon cassette such that a ratchet pawl mechanism in the 2170 printer engages a ratchet in the ink ribbon cassette, thereby insuring advancement of the ink ribbon when the 2170 printer prints.

* * * * *